US005335917A

United States Patent [19]

Kuna

[11] Patent Number: 5,335,917

[45] Date of Patent: Aug. 9, 1994

[54] GAME APPARATUS AND MOTORIZED BUCKET ASSEMBLY THEREFORE

[75] Inventor: Wayne A. Kuna, River Forest, Ill.

[73] Assignee: Hasbro, Inc., Pawtucket, R.I.

[21] Appl. No.: 4,099

[22] Filed: Jan. 13, 1993

[51] Int. Cl.[5] ..... A63F 9/00

[52] U.S. Cl. ..... 273/445; 446/435; 446/437

[58] Field of Search ..... 273/447, 445, 446, 448, 273/450, 354; 446/433, 435, 437

[56] References Cited

U.S. PATENT DOCUMENTS

| | | | |
|---|---|---|---|
| 1,289,621 | 12/1918 | Blackshear | 446/435 |
| 1,871,297 | 8/1932 | Berger | 446/433 |
| 1,927,861 | 9/1933 | Wypy . | |
| 2,279,386 | 4/1942 | Carver | 446/435 X |
| 2,578,579 | 12/1951 | Mysels . | |
| 3,264,782 | 8/1966 | Glass et al. | 446/435 X |
| 3,582,070 | 6/1971 | Breslow | 273/445 |
| 3,794,318 | 2/1974 | Holmes | 273/354 |
| 4,453,340 | 6/1984 | Kozuka et al. . | |
| 4,575,354 | 3/1986 | Wakayama et al. | 446/437 |
| 4,693,697 | 9/1987 | Pagano . | |
| 4,772,242 | 9/1988 | McKay et al. . | |
| 4,988,099 | 1/1991 | Kuna et al. | 273/445 |

FOREIGN PATENT DOCUMENTS

| | | | |
|---|---|---|---|
| 1025439 | 6/1983 | U.S.S.R. | 446/433 |
| 680189 | 10/1952 | United Kingdom | 446/433 |

*Primary Examiner*—Paul E. Shapiro
*Attorney, Agent, or Firm*—Kurt R. Benson

[57] ABSTRACT

A game apparatus includes a motorized bucket assembly, a plurality of game balls, and a plurality of shovel elements which are operative for scooping up the game balls and placing them in the bucket assembly. The motorized bucket assembly includes a bucket element which is rotatably supported on a pair of wheels, and one of the wheels includes a discontinuous surface thereon so that the bucket element is periodically turned as it is moved across a supporting surface. The bucket assembly further includes a spring biased plunger which is operative for shooting the game balls outwardly from the bucket element through an aperture in the outer wall thereof while the bucket element is moved across the supporting surface. An on/off switch is provided for selectively energizing a drive for the bucket assembly and a handle is attached to the switch so that the drive is energized when the handle is pushed downwardly, and de-energized when the handle is pulled upwardly. Game players must attempt to quickly gather their balls with their shovel elements and drop them in the bucket element before the plunger assembly shoots them back out. The first player to deposit all of his or her balls in the bucket element and pull the handle up to stop the drive is the winner.

12 Claims, 4 Drawing Sheets

GAME APPARATUS AND MOTORIZED BUCKET ASSEMBLY THEREFORE

BACKGROUND OF THE INVENTION

The instant invention relates to the toy art, and more particularly to game apparatus which includes a motorized bucket assembly.

Toys which move across supporting surfaces, such as cars or push toys, have heretofore been known to have significant play value. Further, toys which shoot balls or other articles have also been found to have significant play value. For example, the U.S. patents to Wypy U.S. Pat. No. 1,927,861; Mysels U.S. Pat. No. 2,578,579; Pagano U.S. Pat. No. 4,693,697; McKay et al U.S. Pat. No. 4,772,242; and Kozuka et al U.S. Pat. No. 4,453,340 are illustrative of such devices. The patent to Wypy discloses a push toy comprising a cart which is rotatably supported on a plurality of wheels, and a wooden figure having pivoting arm and leg members. The arm and leg members of the figure are connected to the wheels of the cart via a connecting rod so that the arm and leg members move as the wheels turn. The patent to Mysels discloses a push-toy with a transparent dome and a plurality of balls which are agitated within the dome as the push-toy is moved across the floor. The patent to Pagano discloses another push-toy comprising a turtle body which is rotatably supported on a plurality of wheels. The shell of the turtle is transparent and a plurality of balls are located in the body below the transparent shell. The balls are agitated as the toy is moved over a supporting surface. The McKay patent is directed to a wheeled toy with reciprocating arm elements. A pair of arm members are pivotably attached to the frame of the toy and are pivoted up and down as the toy moves across a supporting surface. The Kozuka patent relates to a jack-in-the-box toy which is mounted on wheels. The wheels include notches therein which cause the toy to rock and bounce as it is propelled over a supporting surface. The jack-in-the-box periodically pops upwardly out of a top portion of the device as it moves.

SUMMARY OF THE INVENTION

The instant invention provides game apparatus including a motorized bucket assembly which shoots balls from a mouth portion of the bucket assembly while the bucket assembly travels in a circular pattern.

Briefly, the game apparatus comprises a motorized bucket assembly, a plurality of balls, and a plurality of shovel elements. The motorized bucket assembly comprises a bucket element, a pair of wheel rotatably mounted on the lo bucket element, a pair of arm members pivotably mounted on the bucket element, a spring biased plunger and a drive assembly. The bucket element includes a bottom wall and an outer wall which cooperate to define an upwardly opening interior portion. The interior portion is operative for receiving the game balls therein. The outer wall includes a sculpted face portion thereon, and an aperture is formed in the outer wall where the mouth of the face portion is located. A feeder plate is mounted inside the bucket element, and it is operative for feeding the game balls toward the aperture in the outer wall. A handle is mounted on the bucket element. The wheels are rotatably mounted on the bucket element for rotatably supporting the bucket element on a supporting surface. One of the wheels is circular in shape, and the other wheel includes an arcuate surface and a flat surface thereon. The flat surface on the wheel is operative for periodically causing the bucket element to be turned as the wheels rotate so that the bucket element is propelled across the supporting surface in a circular pattern. Each of the arm members is pivotably mounted on the bucket element and each includes a hand portion which extends over the interior portion of bucket element. The arm members are further rotatably connected to the wheels so that the hand portions are reciprocated back and forth over the interior portion of the bucket element. The spring biased plunger is mounted in the interior portion of the bucket element adjacent the aperture in the outer wall and it is operative for shooting the game balls outwardly of the bucket element through the aperture as the bucket element is propelled across a supporting surface. The drive assembly comprises an electric motor and a set of gears which are associated with the electric motor, the wheels, and the plunger. The motor and the gears operate to rotate the wheels in unison and to actuate the plunger to expel the balls from the bucket element. The bucket assembly further includes a switch which is electrically connected between the batteries and the motor for selectively energizing the motor. One end of the handle is attached to the switch so that the motor is energized when the handle is pushed downwardly and de-energized when the handle is pulled upwardly.

The game balls preferably comprise four differently colored sets of three balls each (twelve balls in all). The shovel elements are operative for scooping up the game balls and they are preferably color coded to match the sets of colored balls.

For use of the game apparatus, game players randomly scatter the game balls on the floor near the motorized bucket assembly, and then each chooses a colored shovel element. If there are less than four players, the extra shovel elements and corresponding color game balls are placed out of play. When the players are ready, the handle is pressed downwardly to energize the bucket assembly wherein the bucket assembly begins moving around the supporting surface in a circular pattern. The object of the game is for the players to scoop up their matching color game balls, one at a time, and quickly drop the balls into the bucket. After scooping one ball and depositing it into the bucket element, the player must scoop up another matching ball and drop it into the bucket element. In the meantime, the balls which are deposited into the bucket element are expelled outwardly of the bucket element by the plunger. The players must continuously scoop up their matching color balls and drop them into the bucket until all three of one player's balls are inside the bucket. When all of one player's balls are inside the bucket element, the player must pull upwardly on the handle and de-energize the bucket assembly to win the game.

Accordingly, it is an object of the invention to provide a game apparatus for playing an amusing game.

It is another object to provide a motorized bucket assembly which is mounted on wheels and which moves in a circular pattern across a supporting surface.

It is still another object to provide a motorized bucket assembly which receives balls in an interior portion thereof and which shoots the balls from a mouth portion while the bucket is moving in a circular pattern.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
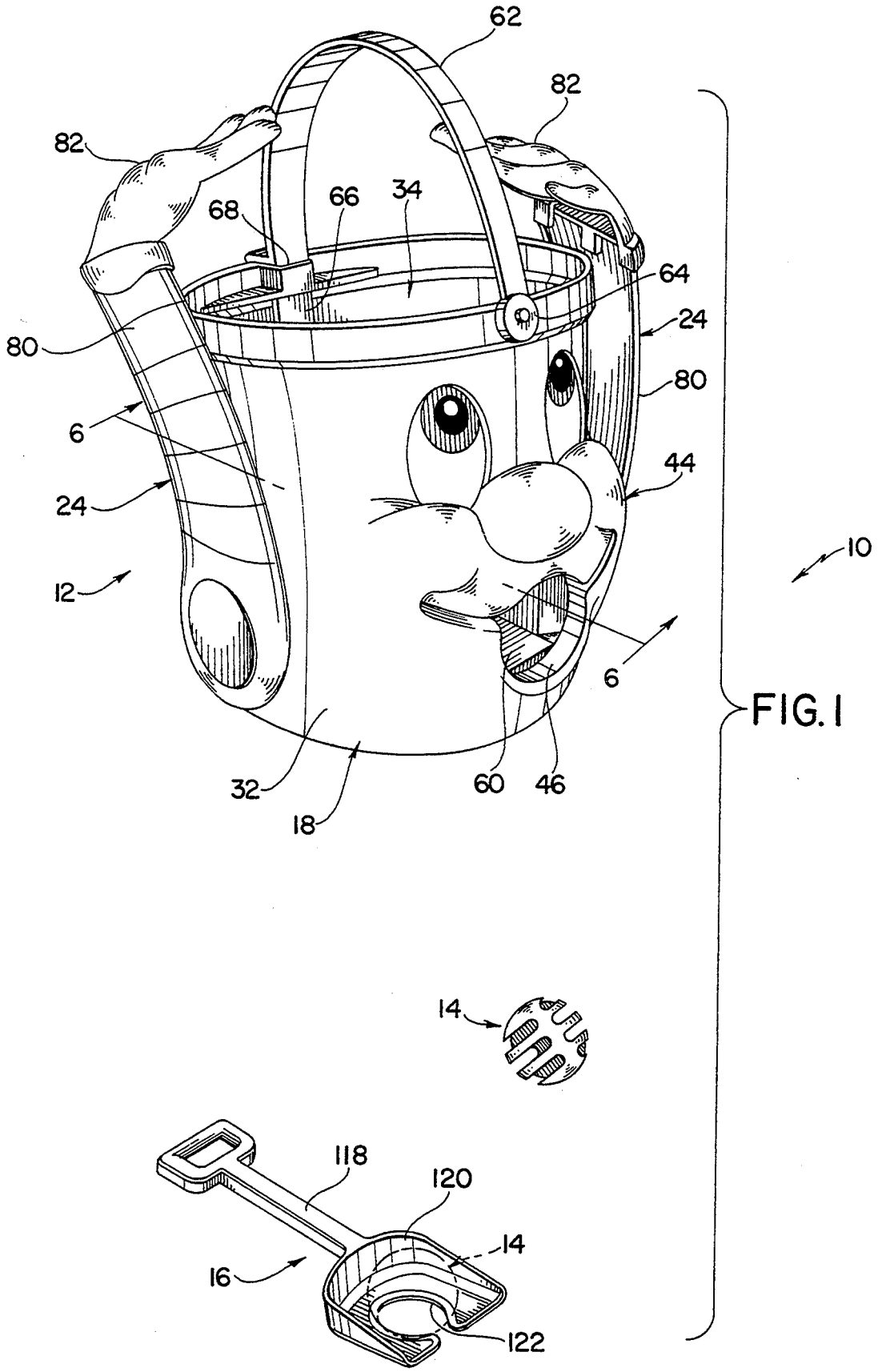
FIG. 1 is a perspective view of the game apparatus of the instant invention.
Figure 2:
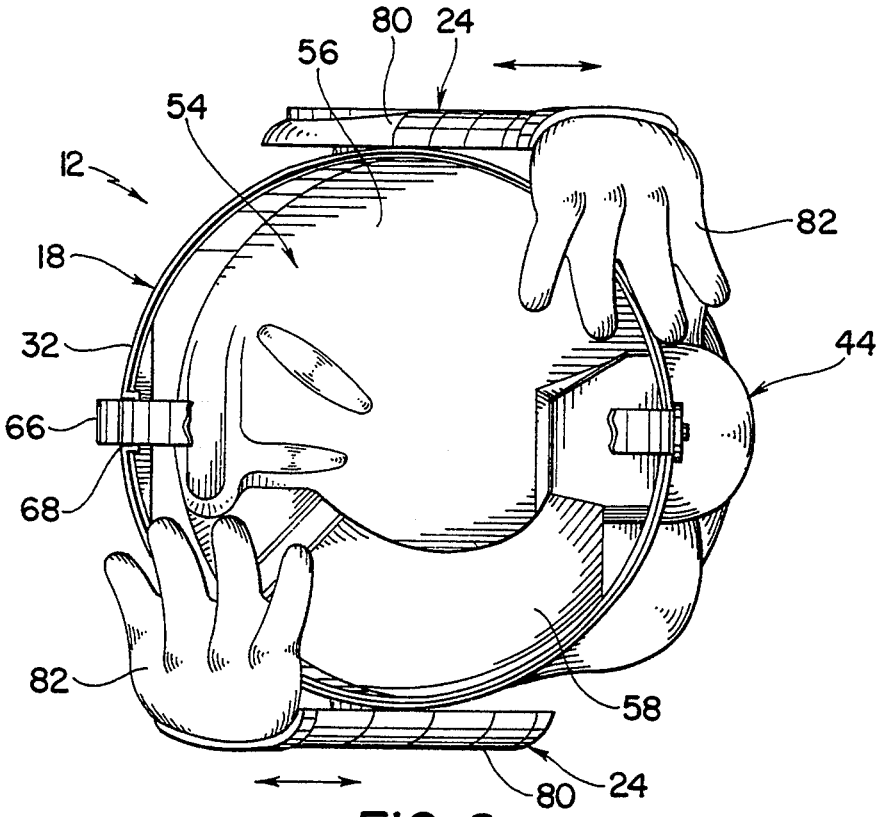
FIG. 2 is a top plan view of the motorized bucket assembly.
Figure 3:
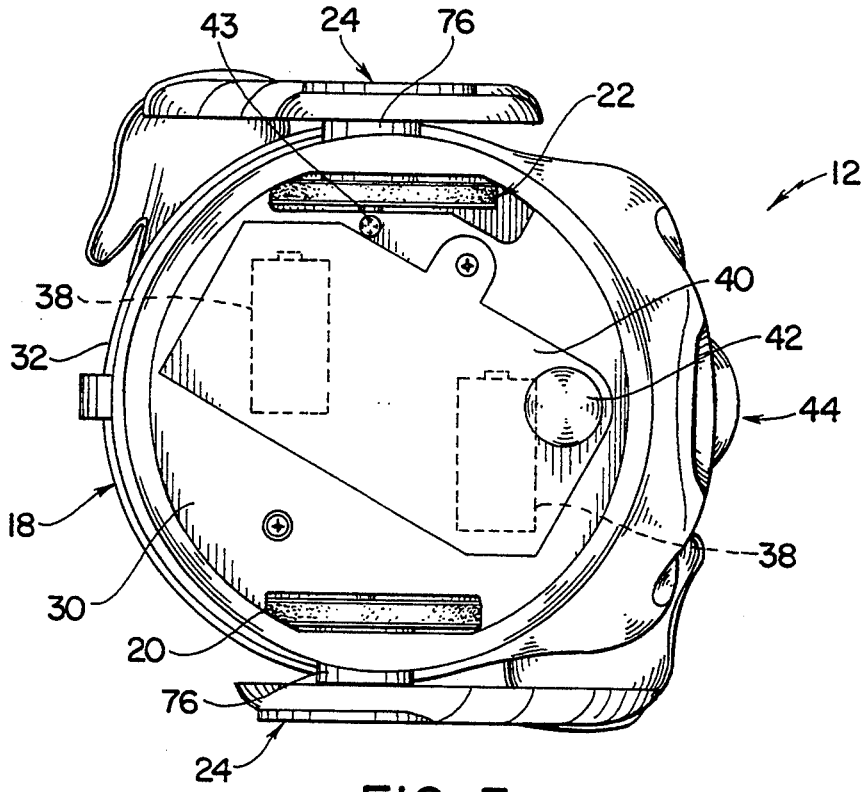
FIG. 3 is a bottom plan view thereof.

Referring now to the drawings, the game apparatus of the instant invention is illustrated and generally indicated at 10 in FIG. 1. The game apparatus 10 comprises a motorized bucket assembly generally indicated at 12, a plurality of game balls generally indicated at 14, and a plurality of shovel elements generally indicated at 16.

Referring now to FIGS. 1 through 6, the motorized bucket 12 assembly comprises a bucket element generally indicated at 18, a pair of wheels 20 and 22, respectively, a pair of arm members generally indicated at 24, a spring biased plunger generally indicated at 26, and a drive assembly generally indicated at 28.

The bucket element 18 includes a bottom wall 30 and an outer wall 32 which cooperate to define an upwardly opening interior portion generally indicated at 34. The interior portion 34 of the bucket element 18 is operative for receiving the game balls 14 therein during game play. The bottom wall 30 includes two rectangular battery compartments 36 for receiving two "c" size batteries 38, an access panel 40 which is removable to insert the batteries 38 into the appropriate compartments 36, a large nub 42, and a smaller nub 43 adjacent the wheel 22. The outer wall 32 includes a sculpted face portion generally indicated at 44, and an aperture 46 is formed in the outer wall 32 at the mouth area of the face portion 44. The outer wall 32 further includes a pair of openings generally indicated at 48 which are circumferentially spaced from the aperture 46 on opposite sides of face portion 44. Each of the openings 48 includes a circular portion 50 and a slot portion 52 which extends outwardly therefrom. The bucket element 18 further includes a feeder plate 54 mounted in the interior portion 34 which is operative for receiving the game balls 14 and for feeding them toward the aperture 46 in the outer wall 32. The feeder plate 54 includes a horizontal surface 56 for receiving the game balls 14 thereon and a sloping surface 58 for feeding the game balls 14, one at a time, to a ball seat 60 adjacent the aperture 46 in the outer wall 32.

The motorized bucket assembly 12 further includes a handle 62 having a first end 64 which is snap mounted on the front of the bucket element 18 and a second end 66 which is slidably received in a slot at the rear of the bucket element 18.

The wheels, 20 and 22, are rotatably mounted in the bucket element 18 and they cooperate with the large nub 42 to rotatably support the bucket element 18 on a supporting surface, such as a hard floor. The first wheel 20 is circular in shape and the second wheel 22 includes an arcuate surface portion 70 and a flat spot or disconinuous surface portion 72 thereon. The wheels 20 and 22 are mounted on an axle 74 which extends through the bucket element 18, and the axle 74 is driven by the drive assembly 28 for movement of the bucket element 18 across a supporting surface. The discontinuous surface 72 on the wheel 22 is operative for periodically causing the bucket element 18 to be turned as both of the wheels 20 and 22 rotate in unison. More specifically, when the discontinuous surface portion 72 on the wheel 22 rotates over the supporting surface, the wheel 22 temporarily loses contact with the supporting surface wherein the bucket element 18 is supported by the large nub 42, the small hub 43 and the first wheel 20. When the second wheel 22 loses contact with the supporting surface, the circular wheel 20 remains in contact with the supporting surface and continues to rotate wherein the bucket element 18 is caused to pivot about the nub 43 to turn the bucket element 18. When the wheel 22 rotates past the flat spot 72, the arcuate surface portion 70 regains contact with the supporting surface causing the bucket element 18 to be again moved in a linear direction across the supporting surface. As the wheel 22 is continually rotated past the flat spot 72, the bucket element 18 is repeatedly pivoted on nub 43 causing the bucket element 18 to be moved in a circular pattern over the supporting surface. Each of the wheels 20 and 22, further include a reduced diameter hub 76. The hubs 76 extend outwardly of the bucket element 18 through the circular portions 50 of the side openings 48 in the outer wall 32, and each hub 76 has an eccentric bore 78 formed therein.

Figure 4:
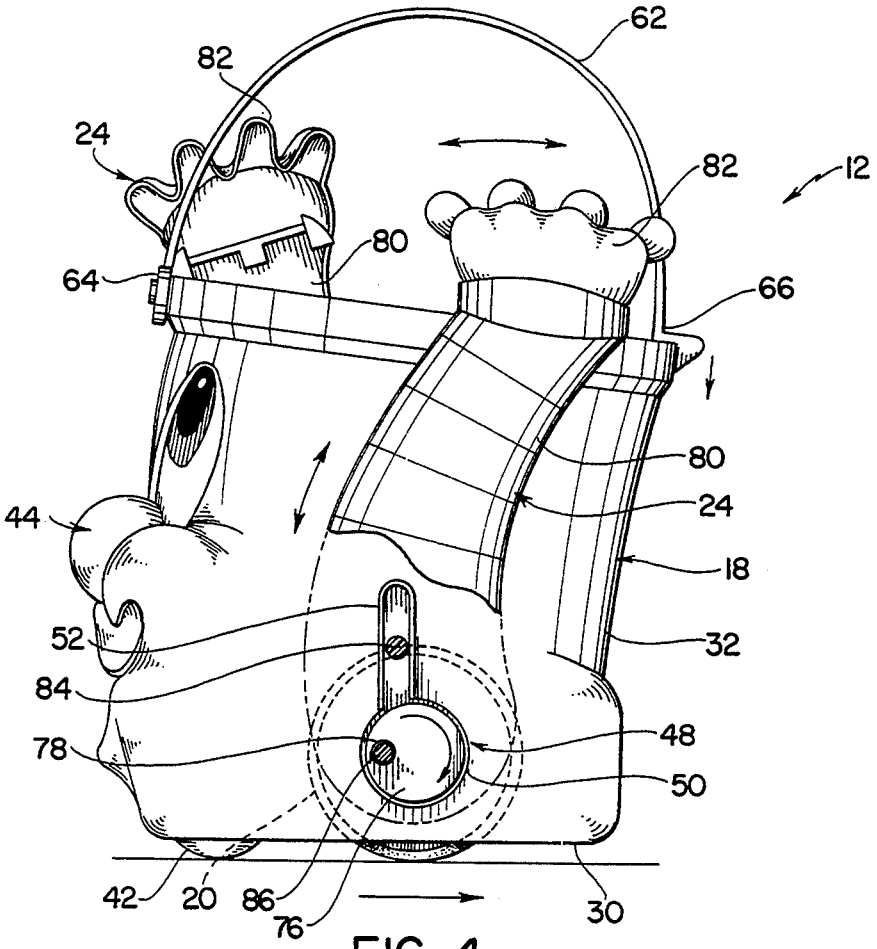
FIG. 4 is a left side elevational view thereof with one arm member partially broken away to show the attachment thereof to the wheel and bucket element.
Figure 5:
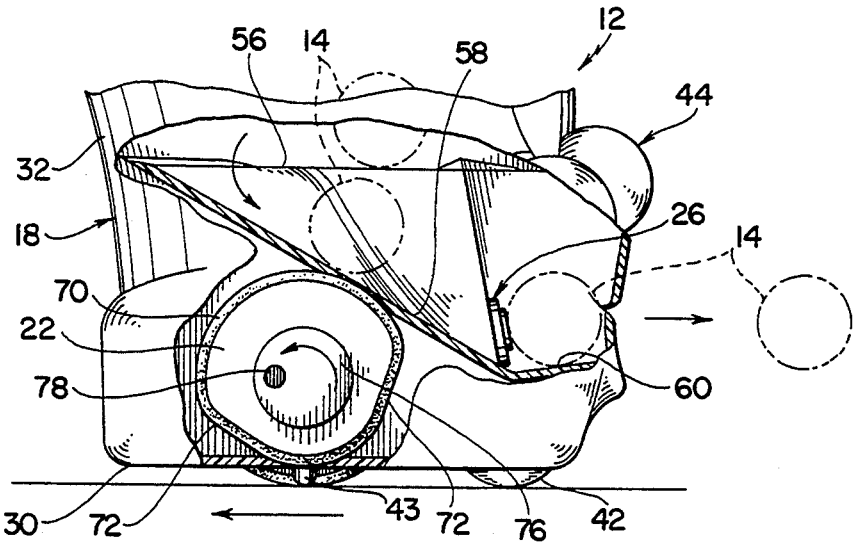
FIG. 5 is a right side elevational view thereof with the bucket element partially broken away to show the ball seat and the sloping feeder plate surface.

Each of the arm members 24 includes an arm portion 80 which is pivotably mounted on the bucket element 18 and a hand portion 82 which extends over the interior portion 34 of the bucket element 18. The arm portions 80 each include upper and lower mounting posts 84 and 86, respectively. The lower mounting posts 86 are received in the bores 78 in the hubs 76 of the wheels 20 and 22, and the upper mounting posts 84 are slidably received in the slotted portions 52 of the side openings 48 in the outer wall 32. In FIG. 4, it can be seen that rotation of the wheels 20 and 22 causes the lower mounting posts 86 to move in a circular motion while the upper mounting posts 86 move up and down in the slot 52. In this regard, rotation of the wheels 20 and 22 causes the arm members 24 to move up and down and the hand portions 82 to move back and forth over the interior portion 34 of the bucket element 18. It is pointed out that the bores 78 in the wheels are aligned in offset relation so that when one arm member 24 moves upwardly and forwardly, the opposite arm member 24 moves downwardly and rearwardly.

Figure 6:
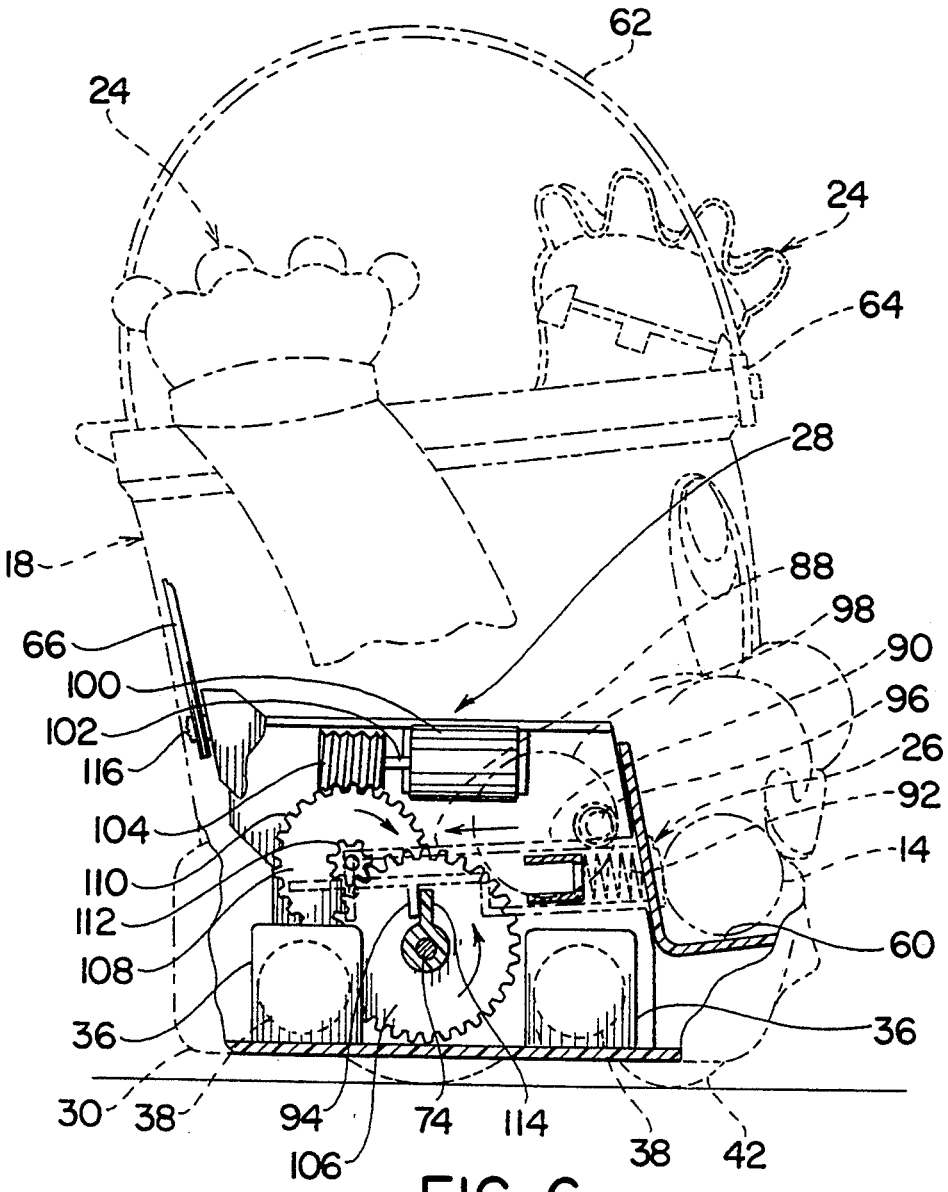
FIG. 6 is a cross sectional view thereof taken along line 6—6 in FIG. 1.

Referring now to FIG. 6, the spring biased plunger 26 is mounted in the interior portion 34 of the bucket element 18 adjacent ball seat 60, and it is operative for shooting the game balls 14 outwardly from the bucket element 18 through the aperture 46 as the bucket element 18 is propelled across a supporting surface. It is pointed out that the bucket element 18 moves in a rearward direction and that the balls 14 are expelled forwardly as the bucket 18 moves rearwardly (See FIG. 5). The plunger 26 comprises a shaft portion 88, a head portion 90, and a coil spring 92. The shaft portion 88 includes a small tab 94 projecting outwardly therefrom, and the head portion also includes a small striker 96 thereon.

The motorized bucket assembly further includes a bell 98 which is struck by the striker 96 each time the plunger 26 moves forwardly to expel a game ball 14 from the bucket element 18.

The drive assembly 28 comprises a conventional electric motor 100 having a drive shaft 102 and a worm gear 104 mounted thereon, a drive gear 106 mounted on the wheel axle 74 and a transmission gear 108. The worm gear 104 intermeshes with a first gear surface 110 on the transmission gear 108 to rotate the transmission gear 108 in a clockwise direction. The drive gear 106 intermeshes with a reduced diameter gear surface 112 on the transmission gear 108 to rotate the drive gear 106 in a counterclockwise direction. The hub of the drive gear 106 includes a radial projection 114 which engages with the tab 94 on the shaft 88 of the plunger 26. As the drive gear 106 rotates counterclockwise, the radial projection 114 engages the tab 94 and forces the plunger 26 rearwardly against the bias of the coil spring 92. As the drive gear 106 is rotated further, the radial projection 114 is disengaged from the tab 94 and the plunger 26 is released so that it rapidly travels forward and shoots the game ball 14 in the ball seat 60 outwardly from the bucket element 18. When the plunger 26 travels forwardly, the striker 96 strikes the bell 98 so that a ringing sound is effected when the ball 14 is shot out of the bucket element 18. It is pointed out that the rotation of the drive gear 106 is coordinated with the flat spot 72 on the wheel 22 so that the balls 14 are expelled from the bucket element 18 as the bucket element 18 is turning.

The motorized bucket assembly 12 further includes a switch 116 which is electrically connected between the batteries 38 and the electric motor 100 for selectively energizing the motor 100. The second end 66 of the handle 62 includes an aperture which is received over the switch 116. (See FIG. 6). The switch 116 is operative so that the electric motor 100 is energized when the second end 66 of the handle 62 is moved downwardly, and de-energized when the handle is pulled upwardly. (See FIG. 4).

The game balls 14 preferably comprise four differently colored sets of three balls each (twelve balls in all).

The shovel elements 16 each comprise a handle portion 118 and a scoop portion 120 having a rounded opening 122 therein. The shovel elements 16 are operative for scooping up the game balls 14, and the rounded openings 122 in the scoop portions 120 form seats for the game balls 14 thereby facilitating retention of the game balls 14 in the scoop portions 120. The shovel elements 16 are preferably color coded to match the four sets of colored balls 14.

For use of the game apparatus 10, the motorized bucket assembly 12 is placed on a suitable supporting surface, and the game balls 14 are randomly scattered on the floor near the motorized bucket assembly 12. It is pointed out that the motorized bucket assembly 12 works best on a hard floor, and therefore carpeted areas should be avoided. Each of the players then chooses a colored shovel element 16 for scooping up the game balls 14, and the players gather around the motorized bucket assembly 12. If there are less than four players, the extra shovel elements 16 and corresponding color game balls 14 may be placed out of play. When the players are ready, the second end 66 of the handle 62 is pressed downwardly to energize the motorized bucket assembly 12 wherein the bucket assembly 12 begins moving around the supporting surface in a circular pattern. The object of the game is for the players to quickly scoop up their matching color game balls 14, one at a time., and deposit the balls 14 into the bucket element 18. After scooping up one ball 14 and depositing it into the bucket element 18, a player must scoop up another matching ball 14 and drop it into the bucket element 18. In the meantime, the balls 14 which have been deposited in the bucket element 18 are sequentially fed to the ball seat 60 where they are expelled outwardly of the bucket element 18 and back onto the floor by the plunger 26. The players must continuously scoop up their matching color balls 14 and drop them into the bucket element 18 until all three of one player's balls 14 are inside the bucket element 18. When all three of a player's game balls 14 are inside the bucket element 18 at the same time, the player must pull upwardly on the handle 62 and de-energize the bucket assembly 12 to win the game.

It is seen therefore that the instant invention provides an amusing game apparatus 10 and motorized bucket assembly 12 therefor. The motorized bucket assembly 12 is rotatably supported on a pair of wheels 20 and 22, and one of the wheels 22 includes a flat spot 72 thereon so that the bucket assembly 12 is periodically turned when moving across a supporting surface. The bucket assembly 12 further includes a spring biased plunger 26 which is operative for shooting the game balls 14 outwardly from the bucket element 18 while the bucket element 18 is moving in a circular pattern across the supporting surface. A handle 62 is attached to an on/off switch 116 and is operative for energizing and de-energizing the bucket assembly 12 during play. For these reasons the game apparatus 10 and the motorized bucket assembly 12 are believed to represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game apparatus comprising:

a plurality of game balls;

a bucket element having a bottom wall and an outer wall which cooperate to define an upwardly opening interior portion, said outer wall having an aperture therein, said game balls being receivable in said interior portion of said bucket element;

wheel means rotatably mounted on said bucket element for rotatably supporting said bucket element on a supporting surface;

drive means for rotating said wheels;

switch means for selectively activating said drive means, said switch means being mounted in a vertical orientation on said outer wall, said switch means being movable between an upper position wherein said drive means is de-activated, and a lower position wherein said drive means is activated;

an upwardly extending handle element on said bucket element, said handle element having an end portion which is operatively attached to said switch means, said handle element being operative for movement of said switch means wherein said drive means is activated when said handle element is moved downwardly and said drive means is de-activated when said handle element is pulled upwardly;

means for periodically causing said bucket element to be turned as it is moved across said supporting surface; and shooting means in said bucket element for shooting said game balls outwardly from said bucket element through said aperture in said outer wall as said bucket element is moved across said supporting surface.

2. In the game apparatus of claim 1, said wheel means comprising first and second wheels.

3. In the game apparatus of claim 2, one of said wheels having a discontinuous surface thereon which is operative for periodically causing said bucket element to be turned when said wheels are rotated in unison.

4. The motorized bucket assembly of claim 1 further comprising a feed plate in said interior portion of said bucket element, said feed plate feeding said balls, one at a time to said shooting means for expulsion through said aperture.

5. A game apparatus comprising:

a plurality of game balls;

a bucket element having a bottom wall and an outer wall which cooperate to define an upwardly opening interior portion, said outer wall having an aperture therein, said game balls being receivable in said interior portion of said bucket element;

wheel means rotatably mounted on said bucket element for rotatably supporting said bucket element on a supporting surface;

drive means for rotating said wheels;

switch means for selectively activating said drive means;

means for periodically causing said bucket element to be turned as it is moved across said supporting surface;

shooting means in said bucket element for shooting said game balls outwardly from said bucket element through said aperture in said outer wall as said bucket element is moved across said supporting surface;

a pair of arms each having a hand portion at one end thereof, said arms being pivotably mounted on said bucket element so that said hand portions extend over the interior portion of said bucket element; and means for pivoting said arms to that said hand portions are moved back and forth over the interior portion of said bucket element.

6. A game apparatus comprising:

a plurality of game balls;

a bucket element having a bottom wall and an outer wall which cooperate to define an upwardly opening interior portion, said outer wall having an aperture therein, said game balls being receivable in said interior portion of said bucket element;

wheel means rotatably mounted on said bucket element for rotatably supporting said bucket element on a supporting surface;

drive means for rotating said wheels;

switch means for selectively activating said drive means;

means for periodically causing said bucket element to be turned as it is moved across said supporting surface;

shooting means in said bucket element for shooting said game balls outwardly from said bucket element through said aperture in said outer wall as said bucket element is moved across said supporting surface; and a plurality of shovel elements for scooping up said game balls.

7. A motorized bucket assembly comprising:

a bucket element having a bottom wall and an outer wall which cooperate to define an upwardly opening interior portion, said outer wall having an aperture therein;

wheel means rotatably mounted on said bucket element for rotatably supporting said bucket element on a supporting surface;

drive means for rotating said wheels;

switch means for selectively activating said drive means, said switch means being mounted in a vertical orientation on said outer wall, said switch means being movable between an upper position wherein said drive means is de-activated, and a lower position wherein said drive means is activated;

an upwardly extending handle element on said bucket element, said handle element having an end portion which is operatively attached to said switch means, said handle element being operative for movement of said switch means wherein said drive means is activated when said handle element is moved downwardly and said drive means is de-activated when said handle element is pulled upwardly;

means for periodically causing said bucket element to be turned as it is moved across said supporting surface; and shooting means in said bucket element for shooting a plurality of game balls outwardly of said bucket element through said aperture in said outer wall as said bucket element is moved across said supporting surface.

8. In the game apparatus of claim 7, said wheel means comprising first and second wheels.

9. In the game apparatus of claim 8, one of said wheels having a discontinuous surface thereon which is operative for periodically causing said bucket element to be turned when said wheels are rotated in unison.

10. A motorized bucket assembly comprising:

a bucket element having a bottom wall and an outer wall which cooperate to define an upwardly opening interior portion, said outer wall having an aperture therein;

wheel means rotatably mounted on said bucket element for rotatably supporting said bucket element on a supporting surface;

drive means for rotating said wheels;

switch means for selectively activating said drive means;

means for periodically causing said bucket element to be turned as it is moved across said supporting surface;

shooting means in said bucket element for shooting a plurality of game balls outwardly from said bucket element through said aperture in said outer wall as said bucket element is moved across said supporting surface;

a pair of arms each having a hand portion at one end thereof, said arms being pivotably mounted on said bucket element so that said hand portions extend over the interior portion of said bucket element; and means for pivoting said arms so that said hand portions are moved back and forth over the interior portion of said bucket element.

11. A motorized bucket assembly comprising:

a bucket element having a bottom wall and an outer wall which cooperate to define an upwardly opening interior portion, said outer wall having an aperture therein;

a pair of wheels rotatably mounted in said bucket element for rotatably supporting said bucket element on a supporting surface, one of said wheels having a discontinuous surface thereon which is operative for periodically causing said bucket element to be turned when said wheels are rotated in unison;

electric motor means;

electric power means for energizing said electric motor means;

switch means electrically connected between said power means and said motor means for selectively energizing said motor means, said switch means being mounted in a vertical orientation on said outer wall, said switch means being movable between an upper position wherein said electric motor is de-energized and a lower position wherein said electric motor is energized;

an upwardly extending handle means on said bucket element, said handle means having an end portion which is operatively attached to said switch means, said handle means being operative for movement of said switch means wherein said electric motor is energized when said handle means is moved downwardly and said electric motor is de-energized when said handle means is pulled upwardly;

shooting means in said bucket element for shooting a plurality of game balls outwardly from said bucket element through said aperture in said outer wall; and gear means associated with said electric motor means, said wheels and said shooting means, said gear means being operative for rotating said wheels in unison and for actuating said shooting means.

12. A motorized bucket assembly comprising:

a bucket element having a bottom wall and an outer wall which cooperate to define an upwardly opening interior portion, said outer wall having an aperture therein;

a pair of wheels rotatably mounted in said bucket element for rotatably supporting said bucket element on a supporting surface, one of said wheels having a discontinuous surface thereon which is operative for periodically causing said bucket element to be turned when said wheels are rotated in unison;

electric motor means for driving said wheels;

electric power means for energizing said electric motor means;

switch means electrically connected between said power means and said motor means for selectively energizing said motor means;

handle means on said bucket element, said handle means being operatively attached to said switch means;

shooting means in said bucket element for shooting a plurality of game balls outwardly from said bucket element through said aperture in said outer wall;

gear means associated with said electric motor means, said wheels and said shooting means, said gear means being operative for rotating said wheel in unison and for actuating said shooting means; and a pair of arms each having a hand portion at one end thereof and each being pivotably mounted on said bucket element so that said hand portions extend over the interior portion of said bucket element, said arms being pivotably mounted on said wheels wherein rotation of said wheels causes said hand portions to pivot back and forth over the interior portion of said bucket element.

* * * * *